United States Patent [19]

Pierre et al.

[11] 3,948,184

[45] Apr. 6, 1976

[54] SUB-CALIBRE PROJECTILE SHELLS

[75] Inventors: Bernard Pierre, Lyon; Claude Sabin, Vierzon, both of France

[73] Assignee: Etat Francais, Paris, France

[22] Filed: Oct. 10, 1973

[21] Appl. No.: 404,895

[30] Foreign Application Priority Data

Oct. 10, 1972 France ..... 72.35763

[52] U.S. Cl. ..... 102/93; 102/52

[51] Int. Cl.[2] ..... F42B 13/16; F42B 13/06

[58] Field of Search ..... 102/93, 43 P, 52

[56] References Cited

UNITED STATES PATENTS

| | | | |
|---|---|---|---|
| 1,605,655 | 11/1926 | Du Pont | 102/43 P |
| 3,277,825 | 10/1966 | Maillard | 102/52 X |
| 3,446,147 | 5/1969 | Engel et al. | 102/93 |
| 3,507,221 | 4/1970 | Grolly | 102/93 X |
| 3,714,900 | 2/1973 | Feldmann | 102/93 |
| 3,724,377 | 4/1973 | Birkigt | 102/93 |
| 3,747,533 | 7/1973 | Rossmann | 102/93 |
| 3,771,458 | 11/1973 | Schweimler et al. | 102/93 |
| 3,780,658 | 12/1973 | Longueville et al. | 102/52 |
| 3,795,196 | 3/1974 | Hillenbrand | 102/93 |

*Primary Examiner*—Samuel Feinberg
*Assistant Examiner*—C. T. Jordan
*Attorney, Agent, or Firm*—Larson, Taylor & Hinds

[57] ABSTRACT

The shell includes a core wedged rearwardly in a shoe and attached by a glue joint to a destructible plastics skirt fixed to the shoe. The invention is particularly useful for small or medium calibre shells.

22 Claims, 6 Drawing Figures

SUB-CALIBRE PROJECTILE SHELLS

Figure 3:
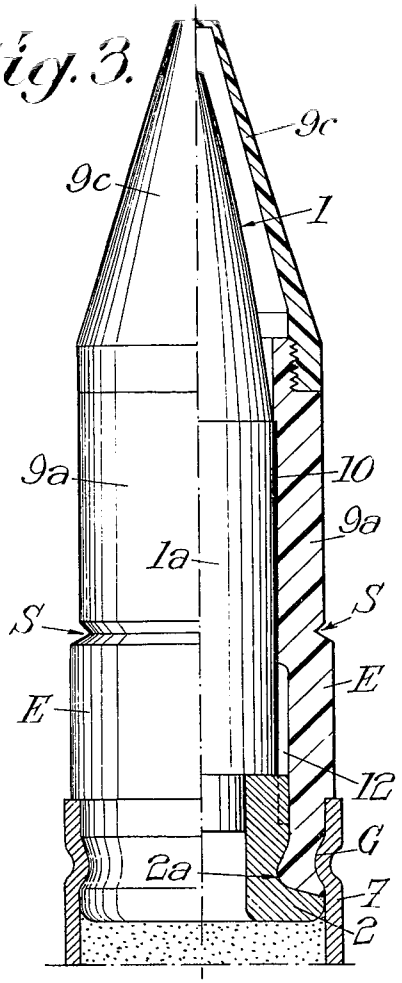

The invention relates to shells with sub-calibre projectiles, especially to those of small or medium calibre (calibre comprised between 15 and 50 mm); and it relates more particularly, because it is in this case that its application seems to offer the most advantages, not exclusively, among these sub-calibre projectile shells, to those of the giratory type, that is to say those destined for firing in a firearm with a rifled barrel capable of imparting to the shell a rotary movement around its axis.

It would seem opportune, before discussing the main feature of the invention, and in order to appreciate better the advantage of this feature, to recall briefly the general construction of a sub-calibre projectile shell, the problems which arise in obtaining correct cooperation of the constitutant elements of such shells, and the drawbacks of the solutions proposed hitherto to resolve these problems.

A conventional sub-calibre projectile shell comprises essentially:

a sub-calibre projectile (i.e. sub-calibre with respect to the calibre of the barrel of the firing weapon), said projectile being constitutable by a single core, whether armour piercing or not, (case of an exercise shell), or again by an armour piercing or non-armour piercing core equipped with a ballistic cap whose role is to reduce the air resistance in the course of the flight of the projectile, a shoe, of the calibre of the firing weapon, playing the role of the base of the shell and comprising a housing, open forwardly, in which is engaged the rear portion of the above said sub-calibre projectile, said shoe being intended to communicate to the sub-calibre projectile, in the barrel of the firearm, a longitudinal acceleration as well as, where necessary, when related to a gyratory shell, an angular acceleration around its axis, and a destructible skirt, generally of plastics material, cleated to the above said shoe and enveloping over at least a certain length the sub-calibre projectile, the above said skirt contributing, before its destruction, to the holding of said projectile.

For a projectile of this type, the skirt is removed by a mechanical destruction at a short distance from the firearm, after which the shoe drops (by reason of the aerodynamic drag to its greater front cross section than that of the sub-calibre projectile), said sub-calibre projectile then pursuing alone its flight towards the target.

It would be appropriate now to specify that the constituant material, the outer shape and the ballistic role of the destructible skirt, which have just been considered, do not come within the scope of the invention, such destructible skirts being in particular, in manner known in itself, either, belonging to a destructible cap entirely surrounding the sub-calibre projectile and terminated forwardly by an ogive bringing the length and the shape of the shell to conform with those of a conventional projectile of the calibre, or, be truncated forwardly and arranged so as to be destroyed at the mouth of the firearm under the effect of aerodynamic forces and centrifugal forces, or, again, be truncated forwardly and arranged as in the preceding case, but being provided with an attached ogive destructible at the mouth of the firearm.

In the following the expression "destructible skirt of a sub-calibre projectile shell" encompasses all the possibilities which have been envisaged for such a skirt, as well as any other solution past or future, provided only that it relates indeed to a destructible skirt (preferably of plastics material) surrounding the lateral wall of the sub-calibre projectile over a certain length and contributing, before its destruction at the mouth of the firearm, to the holding of said projectile.

Again within the scope of the generalities relating to sub-calibre projectile shells, it would seem useful to indicate the problems of temporary solidarization or bonding which arise, for the sub-calibre projectile and for the shoe intended to accelerate said projectile in the barrel of the firing weapon (both axially in the commonest case of a gyratory shell) before dropping in front of the firearm and allowing the sub-calibre projectile to pursue its flight alone.

In fact, it is indispensable, for obvious reasons inherent in the constitution itself, of a projectile of this type, that the sub-calibre projectile remain axially rigid with the shoe during the phases preceding the firing, especially during storage, and feeding of the weapon, this axial solidarization having to cease at the mouth of the firearm to enable the freeing of the sub-calibre projectile and the pursuit of its flight.

Besides, when it relates to a giratory shell, there must exist an angular solidarization of the sub-calibre projectile and of its shoe at least during the initial phase of firing, in the barrel of the weapon, so that the above said projectile actually receives a gyratory impulse.

For convenience of description, there will be denoted below, by the expression "problems of temporary solidarization of the sub-calibre projectile and of the shoe" all the problems, briefly recounted above, concerning the axially temporary bonding, and if necessary, rotational bonding, of the projectile and of the shoe of a sub-calibre projectile shell.

Now, hitherto, it was customary to resort, to resolve these problems, to devices with locking or coupling mechanical parts releasable by accelerations (axial or angular) brought into play, on firing, in the barrel of the firearm or at the mouth of said barrel.

Such devices with temporary locking or coupling mechanical parts had, among other drawbacks, that of requiring special parts (radially expandable split rings or bands, radial or axial pins, tenons and mortises, etc.), which had to be machined with great accuracy, hence of relatively high cost, especially where a small calibre shell is concerned, that of being subject to accidents of operation, compromising especially the release of the sub-calibre projectile, this by reason of the small dimensions of the parts concerned, and of the high axial and centrifugal accelerations to which said parts are subjected in the barrel of the weapon, and that of giving rise to machining operations on the sub-calibre projectile, which operations are delicate when the sub-calibre projectile is a hard armour piercing core, said projectile being in any case rendered fragile, from the mechanical point of view, by such a machining operation.

It is a particular object of the invention to overcome in a simple and economic manner the drawbacks which have just been considered, that is to say, to provide a shell, with a sub-calibre projectile, and destructible skirt, for which the problems of temporary solidarization of the sub-calibre projectile and of the shoe are resolved in a complete manner by particularly simple means and of positive operation requiring no special mechanical part and, a fortiori, no movable mechanical part subject to risks of jamming.

The sub-calibre projectile shell, according to the invention, comprises, in a manner known in itself, a subcalibre projectile (generally but not necessarily an armour piercing core), having a lateral wall of revolution with a straight (cylindrical or cylindro-conic) or curved (ogive shape) meridian line, a shoe playing the role of a base and having a cavity open towards the front in which is engaged the rear portion of said sub-calibre projectile, a destructible skirt (preferably of plastics material) fixed to the above said shoe and mating over a certain length at least the above said lateral wall of revolution of the sub-calibre projectile, and connecting means to resolve the problems of temporary solidarization of the sub-calibre projectile and of the shoe of the abovesaid shell, the shell concerned being characterized in that the abovesaid connecting means are constituted by a bonding layer uniting, over at least a portion of their length, the facing surfaces of the sub-calibre projectile and of the destructible skirt of the shell, the nature and dimensions of this bonding layer being selected so that, taking into account the dimensional and weight characteristics of the constituant members of the shell, and taking into account also the rate of firing envisaged, that, on one hand, the bond ensured by this bonding layer between the sub-calibre projectile and the shoe through the destructible skirt is capable of withstanding, without risk of rupture, the accelerations brought into play in the supply device of the weapon, and on arrival at the firing position of the weapon equipped with the shell concerned, and, on the other hand, the abovesaid bond is broken by the acceleration imparted to the shell on firing, in the barrel of the weapon or at the mouth of said barrel, this rupture of the bond ensuring at the desired moment the desired release of the sub-calibre projectile.

It will be easily understood that such bonding means, constituted by a simple bonding layer (with the exclusion of any mechanical part and a fortiori of any movable mechanical part), necessitate no machining operation on the sub-calibre projectile of the shell and remove all the above mentioned drawbacks, prior connecting means with movable mechanical parts, prior connecting means generally involving machining operations affecting the wall of the subcalibre projectile and then rendering the latter fragile.

The simplicity of such bonding means according to the invention (bonding layer) must not minimize the inventive quality of this solution and, especially, must not tempt a technically erroneous analogy with problems of adherance resolved, since the remotest times, by solutions of glueing to which recourse is still available today in advanced techniques, especially in aerospacial techniques.

In fact, apart from glues usable in the field of packaging (in which field practically no problem of acceleration arises), joints by glueing provided up to the present have been intended to form a permanent bond between two elements to be united in final fashion.

On the contrary, in the case of the invention, the bonding layer uniting the sub-calibre projectile to the destructible skirt surrounding said projectile, constitutes, not an element of final joining, but a temporary bonding means of which the mechanical strength must satisfy a double inequality namely, on one hand, be greater than the separating forces brought into play before firing (especially in the feed device of the weapon and on arrival at the firing position of the cartridge in the cartridge chamber of the weapon), and, on the other hand, be less than the separating forces arising on firing in the barrel of the weapon and/or at the mouth of said barrel.

In other words, and inspite of its surprising simplicity and its total efficiency, such a bonding layer constitutes, in the very particular application which is made of it, a true axial and angular coupling device, releasable above a certain threshold value of separating forces exerted on the sub-calibre projectile, and the destructible skirt surrounding said projectile.

The inventive merit of the joint formed by the bonding layer according to the invention resides in the study in depth carried out by the inventors on the separating forces brought into play respectively before firing and during the initial phase of the latter, on the considerable margin existing between these two families of separating forces (of the order, for a shell of a calibre of 20 mm according to the initial speed, of 200 to 800 kg in the operation preceding firing, and of the order of several tons during the initial phase of firing, that is to say in the barrel of the weapon and/or at the mouth of said barrel), and on the aptitude of the majority of bonding layers (especially conventional industrial glues, used for the adhesion of plastics elements between themselves or to metals) to obtain an overall strength (taking into account the possible glueing surfaces) occuring precisely within the above said margin, that is to say an overall strength which is, on one hand, capable of withstanding the separating forces urging before firing the sub-calibre projectile and the destructible skirt surrounding said projectile, and on the other hand, incapable of withstanding the distinctly greater separating forces affecting the same elements in the barrel of the weapon and/or at the mouth of the latter.

Then as regards the bonding layer which has just been considered and which is one of the essential characteristics of the invention, it must be well understood that it relates, in a very general manner, to an intermediate layer of a mechanically strong substance situated between the sub-calibre projectile and the body of the destructible skirt surrounding said projectile, the above said intermediate layer being rigidly fixed to said projectile and said body.

In a particularly simple and advantageous embodiment, this bonding layer is constituted by a "setting substance" distinct from the constituant materials of the sub-calibre projectile and of the destructible skirt and capable of adhesion to these two elements, the expression "setting substance" denoting substances capable of passing, by drying or physical/chemical conversion, from a viscous or pasty liquid state, to a solid state. This substance is then introduced between the sub-calibre projectile and the skirt, in the zone provided for the bonding of these two elements, and, once solidified, said substance actually constitutes a solid seal axially and in rotation rigidifying the abovesaid projectile and the abovesaid skirt as long as the separating forces exerted on these two elements do not exceed a predetermined threshold. Beyond this threshold, there is produced a mechanical destruction (by shearing or tearing away) of the abovesaid solid joint, this destruction ensuring the release of the sub-calibre projectile.

There can then, advantageously, be used as constituant substance of such a solid seal, an industrial glue (of the type of certain glues used in aerospace techniques) capable of adhering both to metals and to plastics materials, such a glue having the advantage of constituting a fluid tight seal between the sub-calibre projectile and the skirt.

By way of example of a glue suitable for the production of such a fluid tight seal, there may be mentioned, especially, industrial glues based on epoxy resin (ARALDITE especially) and industrial glues based on polyurethane (DESMOPHEN and DESMODUR especially).

It will be understood that it is desirable that the sub-calibre projectile, once released as result of the destruction of the solid seal, be free of any residue of the constituant substance of this seal, such residues risking, if they were present on the surface of the projectile, disturbing the flow of air along the wall of said projectile on flight of the latter, which flight could then be slowed and disturbed (deviated).

It is hence advantageous to provide special means so that the residues of the constituant substance of the solid seal adhere to the destructible skirt and not to the sub-calibre projectile, such special means being all the more necessary, in the majority of cases, as the industrial glues envisaged adhere better to metallic materials (materials generally used for the sub-calibre projectile) than to plastics materials (materials generally used for the destructible skirt).

Such special means can then advantageously be constituted by asperities created on the bonding zone of the inner wall of the destructible skirt, the above said asperities being especially capable of having the shape of striae, ridges, tapped threads, etc.

In another embodiment, the bonding layer, intended to temporarily connect the sub-calibre projectile and the skirt surrounding said projectile, is produced in situ, from the constituant material of the skirt, by a superficial physical/chemical transformation of said material at the level of the inner wall of said skirt, this transformation being such that the material thus transformed then has adhesive properties relative to the constituant material of the facing wall of the sub-calibre projectile.

To this end, there can advantageously, when the destructible skirt is of plastics material, be used a local heating of the inner wall of said skirt in the zone provided for the bonding, this local heating being obtainable, for example, by prior heating of the sub-calibre projectile before its placing in position, or by the action of an ultra-sonic beam after the positioning of said projectile.

Taking into account what has just been said, it is then possible, whatever the embodiment adopted for forming the bonding layer, to arrange the assembly of the shell in such a way that its sub-calibre projectile can, on the departure of the shot, effect by inertia, with respect to the shoe, a slight withdrawal stroke having the effect of causing the rupture by shearing of the abovesaid bonding layer.

This withdrawal ability of the sub-calibre projectile with respect to its shoe can be obtained advantageously, either by inserting between the rear section of the projectile and the bottom of the housing formed in the shoe to receive the rear portion of said projectile, an intercalar washer constituted of a compressible material, the solidarization in rotation of the projectile and of the shoe then being ensured, after shearing of the bonding layer, during the travel of the shell in the barrel of the weapon, by wedging, caused by the withdrawal of the projectile, of two coaxial tronconic bearing surfaces and of the same angle at the top open towards the front provided respectively on the rear lateral wall of the projectile and on the facing wall of the housing, formed in the shoe, to receive the rear portion of the above said projectile, or, by constituting the shoe of a material (light alloy for example) less hard than the rear portion of the sub-calibre projectile, so that the latter can withdraw slightly by forming, (if necessary with the interposition of an incompressible washer), in the bottom of the housing formed in the abovesaid shoe, an impression on which the specific contact pressure is then sufficient to ensure the solidarisation in rotation of the projectile and of the shoe in the barrel of the weapon, the rear end of the projectile and the facing wall of its housing in the shoe then being able to be provided cylindrical.

However, it is also possible, according to another solution suitable for gyratory shells, to arrange the assembly of the shell in such a way that its destructible skirt undergoes, at the mouth of the barrel of the weapon and under the effect of centrifugal force, a radial expansion having the effect of breaking, by tearing away this time, the bonding layer uniting the above said destructible skirt to the sub-calibre projectile.

In another complementary feature of the invention, it can sometimes be advantageous, in certain cases where the bonding layer is constituted by a glue (glue joint having to be relatively thick, viscous glue, etc.), to provide a radial gap between the facing walls of the projectile and of the skirt over a length corresponding to the bonding zone.

In such a case, the inner wall of the destructible skirt is preferably made to comprise, at the base of the above said bonding zone, an inner shoulder reestablishing a direct contact with the sub-calibre projectile and forming a sealing joint preventing the glue from flowing into the shoe where it would risk solidarizing said shoe and the rear portion of the sub-calibre projectile, thus risking disturbing the process of separation of these two elements at a certain distance from the mouth of the barrel of the weapon.

When the sub-calibre projectile shell is of gyratory type, it must be made to include at least one rotation conferring belt, intended to come, on firing, into engagement with the internal rifling of the barrel of the firearm.

It is then possible, according to conventional solutions, to introduce such a belt (for example of copper, or of a sintered material or of a plastics material) into a circular groove formed in a lateral wall of the shoe, or again to arrange said shoe so that it has a lateral shoulder forming a body with it and playing the role of a belt.

However it is also possible, according to another complementary feature of the invention, to make the destructible skirt fixed to the sub-calibre projectile, include a peripheral rear shoulder playing the role of a belt, means then being provided to ensure the solidarization in rotation of the above said skirt and of the shoe of the shell.

Such means of solidarization in rotation can be constituted by two sets of longitudinal grooves in engagement formed respectively on the facing walls of the skirt and of the shoe.

Again in the case where the rear portion of the destructible skirt is arranged in form of a band, the performance of the shell from the point of view of firing accuracy (reduction of deviation) can be improved by forming a circular cut in the outer wall of the skirt, immediately forward of the belt forming shoulder.

In any case, that is to say whatever the embodiment of the belt of the shell, the firing accuracy can be improved by giving the zone of the destructible skirt situated in front of said belt, a diameter comprised between that of this belt and the calibre of the weapon, so that this slightly over-calibrated front zone operates also with the inner rifling of the barrel of the weapon (but to a less extent than the enlarged belt forming zone).

Finally, the rear portion of the sub-calibre projectile can also be provided with a luminous tracer device.

As a result of which and whatever the embodiment adopted, there is finally provided a sub-calibre projectile shell whose advantages (simplicity, operational safety, solution of rigidification problems) result clearly from what has just been described.

It should be added also that the bonding layer, characteristic of the invention, can play also the role of a fluid tight seal, a particularly useful role when the destructible skirt is truncated forwardly.

To illustrate more precisely the various features which have just been discussed, there will now be described a certain number of preferred embodiments, but which are not to be regarded as in any way limiting, with reference to the accompanying drawings in which FIGS. 1 to 6 show, in elevation with axial half section, six different embodiments of a sub-calibre armour piercing projectile shell of 20 mm having a destructible skirt of plastics material constructed according to the invention.

Figure 1:
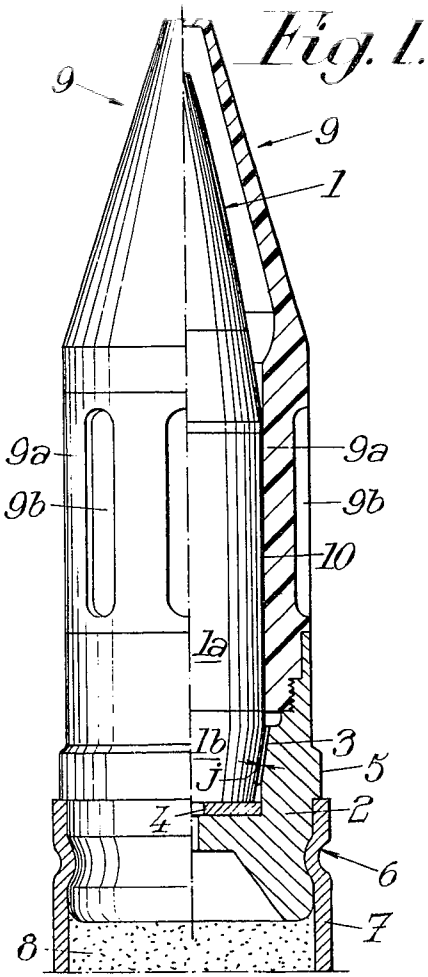

FIG. 1 shows a shell of this type, comprising essentially, a sub-calibre projectile 1 (of steel or of tungsten carbide, or of uranium U238 supplemented by a hardening agent) with a cylindrical body 1*a* ending rearwardly in a frustoconic top portion 1*b* directed rearwardly, a shoe 2, metallic or of plastics material, having a frustoconic cavity 3, open forwardly, with an angle at the top corresponding to that of the frustoconic portion 1*b* of the core, said cavity being intended to receive said frustoconic portion with a lateral gap *j* and the interposition of a compressible washer 4, the above said shoe 2 having a circular shoulder 5 forming an integrated band and a groove 6 for crimping, on the shell, the bush 7 containing the propellent charge 8 of this munition, an ogive shaped cap of plastics material 9 (for example of "Nylon ") having a cylindrical skirt 9*a* of calibre internally striated and with fragilizing cuts 9*b*, said cap attached by screwing on the shoe 2, detaching itself at the mouth of the barrel of the weapon under the effect of centrifugal and aerodynamic forces, and a glue joint 10, for example of "Araldite," temporarily rigidifying the cap 9 and the projectile 1, said joint taking position in the form of a film between the facing cylindrical portions of these two elements.

The behaviour of such a shell on firing is then as follows: on the starting of the shot, the projectile 1 retracts by inertia thereby shearing the glue joint 10 and thereby closing up the lateral gap *j* which has the effect of compressing the washer 4 and of again ensuring the solidarization in rotation (interrupted in transient manner by the shearing of the glue joint 10) of the projectile 1 and of the shoe 2 by wedging of the rear frustoconic portion 1*b* of said core in the housing 3 of corresponding shape formed in the abovesaid shoe; at the mouth of the barrel of the weapon, cap 9 (here including its destructible skirt 9*a*) volatilises and the projectile 1 pursues its flight after having abandoned the shoe 2 (braked by the aerodynamic forces) which falls in front of the weapon.

There will now be described embodiments forming the subject of FIGS. 2 to 6 in which the same reference numerals denote the same elements as in FIG. 1, the description of each of these embodiments relating mainly to their original respective features.

Figure 2:
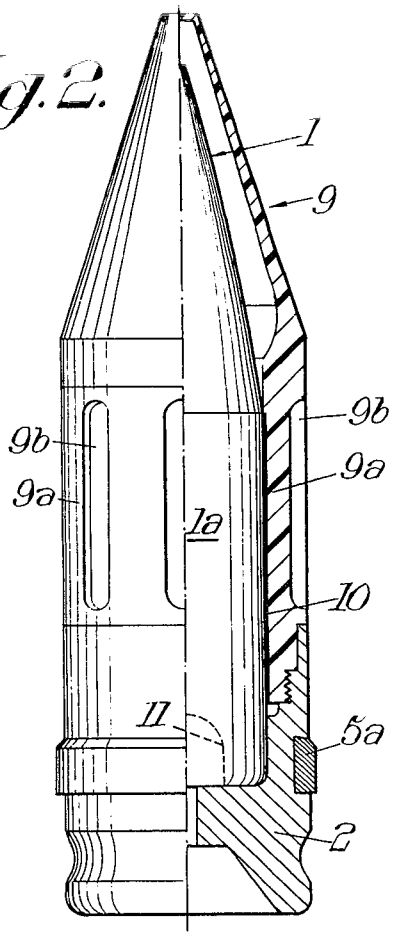

In the case of FIG. 2, the sub-calibre projectile 1 is equipped with a tracer 11 and no longer has a frustoconic rearportion, its cylindrical portion 1a extending up to its rear section which is supported against the bottom of the housing formed in the shoe 2, which bears an attached belt 5a. From the operational point of view, the difference with respect to the case of FIG. 1 resides in the fact that the withdrawal of the core, on starting of the shot (glue joint 10 shearing on withdrawal), is accompanied by the formation, in the bottom of the cavity of the shoe, of an impression ensuring the solidarization in rotation of the projectile 1 and that of the shoe 2 on the travel of the shell in the barrel of the weapon, removal of the cap 9 and the dropping of the abovesaid shoe at the mouth of said barrel then occurring as in the preceding case.

In the case of FIG. 3, the cylindrical portion 1*a* of the projectile 1 is extended to the rear zone of said projectile, the latter being supported on the edge of the housing of the shoe 2, the cylindrical skirt 9*a*, free of longitudinal cuts, is constituted of radially expandable plastics material (polyethylene for example), said skirt being extended forwardly by an attached cap 9*c* destructable by volatilisation at the mouth of the barrel of the weapon, the abovesaid skirt 9*a*, which is internally tapped (depth 0.1 mm and pitch 0.2 mm) has, rearwardly, a belt forming shoulder E, the shoulder framed, forwardly, by a circular fragilising cut S, and rearwardly, by a groove G for the crimping of the bush 7, the skirt 9*a* being itself fixed to the shoe 2 by overmoulding of its rearend in a groove 2*a* formed at the periphery of said shoe, so that, before firing, the skirt 9 occurs clamped between the bush 7 and the shoe 2, the skirt 9*a* and the shoe 2 are angularly solidarised by wedging of two sets of grooves 12 formed respectively in the facing wall of these two elements, the portion of the cylindrical skirt 9*a*, situated in front of the cut S, has a calibre intermediate between that of the firing weapon and the diameter of the shoulder E forming a belt, and the glue joint 10, of thickness 0.1 mm, is constituted by mixture of DESMOPHEN 800 (100 parts by weight) and of DESMODUR (165 parts by weight).

The operation of such a shell is as follows: on the starting of the shot the shoe 2 propels the projectile 1 and the skirt 9*a* axially, the latter imparting a rotary motion, on one hand, to the above said shoe, due to the grooves 12, and on the other hand, partially to the above said projectile due to the glue joint 10; at the mouth of the barrel, the cap 9*c* is detached and the skirt 9*a* undergoes a radial expansion involving the destruction of the glue joint 10 by tearing off, the shoe 2 and the expanded skirt 9*a* dropping close to the weapon, whilst the projectile 1 pursues its flight.

Figure 4:
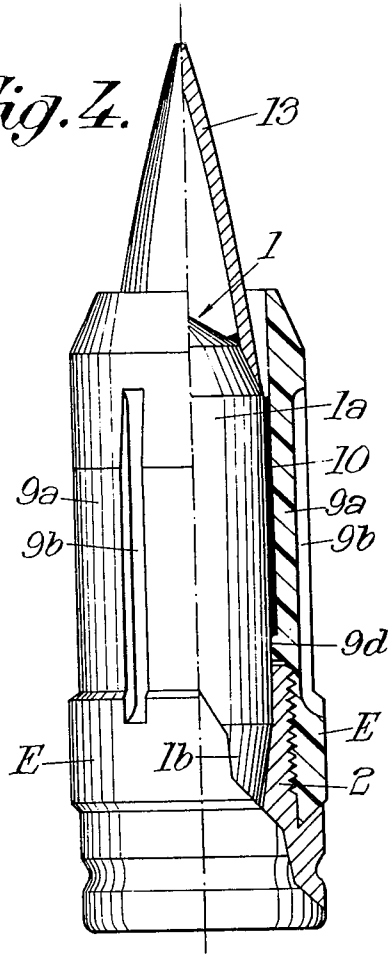

In the case of FIG. 4, the projectile 1 is provided with an attached ballistic cap 13 improving it aerodynamic properties, the destructible skirt 9*a*, of RILSAN polyamide, is truncated forwardly and it surrounds the cylindrical portion 1*a* of the projectile 1 with a certain gap in which the glue joint 10 takes position, which then serves also as a sealing joint, this gap being interrupted rearwardly by an inner shoulder 9*d* of the skirt 9*a*, which shoulder comes into contact with the above said cylindrical portion 1*a* of the core, said skirt 9*a* is fixed by screwing to the shoe 2 and it comprises a shoulder E playing the role of a belt, as well as longitudinal fragilising cuts 9*b*.

The operation of such a shell is as follows: on the starting of the shot, the projectile 1 withdraws thereby shearing the glue joint 10 and wedging its rear conical portion 1b in the shoe 2, said shoe and said projectile then being driven in rotation, by the destructable skirt 9a with the belt E, respectively by the fixing threading of the skirt on the shoe, and by the glue joint 10; at the mouth of the barrel of the weapon, the cylindrical skirt 9*a* is destroyed under the combined effect of the centrifugal and aerodynamic forces, the shoe 2 drops close to the weapon and the projectile 1 (equipped with its attached ogive 13) pursues its flight.

Figure 5:
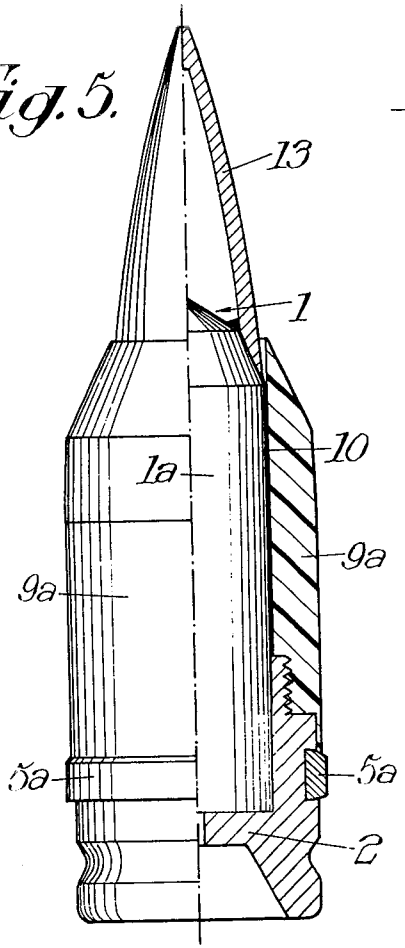

In the case of FIG. 5, the destructible skirt 9a is truncated forwardly, as in the preceding case, and it is arranged so as to undergo, at the mouth of the barrel of the weapon, an expansion ensuring the destruction by tearing away of the glue joint 10, which, up to this stage, contributed to the solidarization in rotation of the projectile 1 and of the skirt 9*a* itself driven in rotation by the shoe 2 equipped with an attached belt 5*a*.

Figure 6:
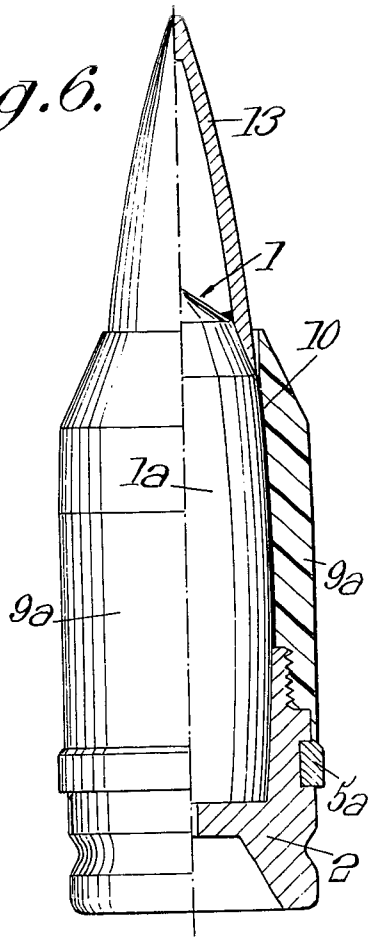

In the case of FIG. 6, lastly, the body 1*a* of the projectile 1 has an ogive shape and the skirt 9*a* has an inner wall of corresponding ogive shape, said skirt, which is fixed by screwing to the shoe 2, being destroyed by radial expansion. The skirt 9*a* is fixed to the projectile 1 by overmoulding on the said previously heated projectile, which causes a surface transformation of the inner wall of said skirt and its adhesion to the above said projectile, the bonding layer 10 being thus obtained without recourse to added glue.

As is self-evident and as emerges already from the foregoing, the invention is in no way limited to those of its types of application and embodiments which have been more especially envisaged; it encompasses, on the contrary, all modifications.

We claim:

1. A shell comprising a sub-calibre projectile having a lateral wall of revolution, a shoe forming a base and having a forwardly open cavity, in which cavity the rear portion of said sub-calibre projectile is engaged, a destructible skirt fixed to said shoe and extending forwardly therefrom and mating over a certain length at least with said lateral wall of revolution of said projectile, and connecting means for temporarily rendering the sub-calibre projectile fast to said shoe, said connecting means comprising a bonding layer joining, over at least a portion of their length, the facing surfaces of the sub-calibre projectile and of the destructible skirt of the shell, the nature and the dimension of this bonding layer being such that, taking into account the weight and dimensional characteristics of the constituent elements of the shell and taking into account also the rate of firing envisaged, on one hand, the connection effected by this bonding layer between the sub-calibre projectile and the shoe through the destructible skirt is capable of withstanding, without risk of rupture, accelerations occurring in a feed device of a firing weapon and on arrival in firing position of the shell, and on the other hand, said connection is broken by the accelerations imparted to the shell on firing, this rupture of the connection ensuring the desired liberation of the sub-calibre projectile.

2. A shell according to claim 1, wherein the bonding layer is constituted by a substance of a character distinct from the constituent materials of the sub-calibre projectile and from the destructible skirt and capable of adhering to these two elements, said substance being applied between said projectile and said skirt so as to form a solid seal adhering to these two elements.

3. A shell according to claim 2, wherein said distinct substance is an industrial glue.

4. A shell according to claim 2, wherein the inner wall of said skirt has, in the zone of said bonding layer, means conferring on the bonding layer an adherence to said inner wall greater than the adherence that said bonding layer effects with respect to the sub-calibre projectile.

5. A shell according to claim 2, wherein the bonding layer applied is housed in a radial gap provided for this purpose between the facing walls of the sub-calibre projectile and the destructible skirt.

6. A shell according to claim 5, wherein the inner wall of the destructible skirt comprises, at the base of said bonding layer, an inner shoulder directly contacting the sub-calibre projectile and forming a sealing joint preventing the substance of the bonding layer from flowing into the shoe.

7. A shell according to claim 1, wherein the bonding layer is formed in situ from the constituent material of the skirt, by a superficial physico-chemical transformation of said material at the level of the inner wall of said skirt, this transformation being such that the material thus transformed then has adhesive properties with respect to the constituent material of the facing wall of the sub-calibre projectile.

8. A shell according to claim 7, wherein the adhesive layer produced in situ is obtained by local heating of the inner wall of the skirt.

9. A shell according to claim 1, wherein the whole shell is constructed and arranged so that its sub-calibre projectile can, on departure of the during firing effect by inertia, with respect to the shoe, a slight withdrawal stroke having the effect of causing rupture by shearing of the bonding layer.

10. A shell according to claim 9, wherein this ability of withdrawal of the sub-calibre projectile with respect to the shoe is obtained by inserting, between the rear section of the projectile and the bottom of the cavity formed in the shoe for receiving the rear portion of said projectile, a washer constituted of a compressible material, the connection in rotation of the projectile and of the shoe being ensured, after shearing of the adhesive layer, and during the course of a shell in the barrel of a weapon, by engagement of two coaxial frustoconic bearing surfaces of the same angle provided respectively on the rear lateral wall of the projectile and on the facing wall of the cavity formed in the shoe for receiving the rear portion of said projectile.

11. A shell according to claim 9, wherein this ability of withdrawal of the sub-calibre projectile with respect to the shoe is obtained by constituting the shoe of a material less hard than the rear portion of the sub-calibre projectile, so that the latter can withdraw slightly by forming in the bottom of the cavity formed in the said shoe, an impression on which the specific contact pressure is then sufficient to ensure the connection in rotation of the projectile and of the shoe in a barrel of the weapon, a rear end of the projectile and the facing wall of the cavity in the shoe being cylindrical.

12. A shell according to claim 1, constructed and arranged so that the destructible skirt undergoes, at the mouth of a barrel of a weapon and under the effect of the centrifugal force, a radial expansion having the effect of breaking, by tearing away, the adhesive layer uniting said skirt with the subcalibre projectile.

13. A shell according to claim 1, wherein said destructible skirt is extended forwardly by an attached destructible cap.

14. A shell according to claim 1, wherein said destructible skirt is constituted by the rear portion of a destructible cap.

15. A shell according to claim 1, wherein said destructible skirt is truncated forwardly.

16. A shell according to claim 1 wherein said destructible skirt comprises a peripheral rear shoulder forming a belt, means being provided to ensure the coupling in rotation of said skirt and of the shoe of the shell.

17. A shell according to claim 16, wherein said means for coupling in rotation comprise two sets of engaged longitudinal grooves formed respectively on the facing walls of the skirt and of the shoe.

18. A shell according to claim 16, wherein the destructible skirt includes a circular cut situated immediately forward of said shoulder forming said belt.

19. A shell according to claim 16, wherein the zone of the destructible skirt, situated forward of the belt of the shell, has a diameter between that of said belt and the calibre of the weapon.

20. A shell according to claim 1, wherein said sub-calibre projectile has an armour-piercing core.

21. A shell according to claim 1, wherein said skirt is of plastics material.

22. A shell according to claim 1, wherein said shoe is of light alloy.

* * * * *